US006739960B2

(12) United States Patent
Sauer

(10) Patent No.: US 6,739,960 B2
(45) Date of Patent: May 25, 2004

(54) TURBINE PORTED GRINDING WHEELS

(75) Inventor: Curtis Rene Sauer, Claremore, OK (US)

(73) Assignee: United Technologies Corporation, Hartford, CT (US)

( * ) Notice: Subject to any disclaimer, the term of this patent is extended or adjusted under 35 U.S.C. 154(b) by 5 days.

(21) Appl. No.: 10/017,005

(22) Filed: Dec. 14, 2001

(65) Prior Publication Data

US 2003/0114095 A1 Jun. 19, 2003

(51) Int. Cl.[7] ..... B24B 55/02

(52) U.S. Cl. ..... 451/449; 451/488; 451/450; 451/541

(58) Field of Search ..... 451/449, 450, 451/488, 541, 178, 53

(56) References Cited

U.S. PATENT DOCUMENTS 524,572 A * 8/1894 Beckert ..... 451/548
3,144,739 A * 8/1964 Brutvan et al. ..... 451/543
3,233,369 A * 2/1966 Highberg ..... 451/260
3,282,263 A * 11/1966 Christensen et al. ..... 125/15
4,854,087 A * 8/1989 Riha ..... 451/541
5,846,125 A * 12/1998 Robichon ..... 451/450
5,993,297 A * 11/1999 Hyatt et al. ..... 451/53

FOREIGN PATENT DOCUMENTS

| | | |
|---|---|---|
| DE | 544 374 | 2/1932 |
| FR | 2 442 695 | 6/1980 |
| GB | 822 058 | 10/1959 |
| WO | WO 00/50202 | 8/2000 |

* cited by examiner

*Primary Examiner*—George Nguyen
(74) *Attorney, Agent, or Firm*—Bachman & LaPointe, P.C.

(57) ABSTRACT

The present invention relates to a ported grinding wheel for use on a grinding machine. The grinding wheel comprises at least one fluid inlet port located on a first surface of the grinding wheel, a plurality of fluid outlet ports on a working surface of the grinding wheel for delivering the fluid to the working surface, and an internal annular channel connecting the inlet port(s) to the plurality of outlet ports.

18 Claims, 5 Drawing Sheets

TURBINE PORTED GRINDING WHEELS

BACKGROUND OF THE INVENTION

The present invention relates to a grinding wheel for use in a grinding machine, which grinding wheel has an internal fluid delivery system for supplying a cooling fluid or a cutting fluid to a working surface of the grinding wheel.

In the prior art, end mill cutters with hollow shafts have been used to machine workpieces. The use of these end mill cutters requires a machine with a hollow coolant-filled spindle used in such machines are very expensive.

Thus, there remains a need for a grinding machine which has a system for delivering coolant or a cutting fluid to the interface between the grinding wheel and the workpiece.

SUMMARY OF THE INVENTION

Accordingly, it is an object of the present invention to provide an improved grinding wheel for use in a grinding machine which has an internal fluid delivery system.

It is a further object of the present invention to provide a grinding wheel as above that has a fluid delivery system which effectively distributes a coolant or a cutting fluid to a working surface of the grinding wheel.

The foregoing objects are attained by the grinding wheels of the present invention.

In accordance with the present invention, a grinding wheel for use in a grinding machine is provided. The grinding wheel broadly comprises at least one fluid inlet port located on a first surface of the grinding wheel, a plurality of fluid outlet ports on a working surface of the grinding wheel for delivering the fluid to the working surface, and internal means connecting the at least one inlet port to the plurality of outlet ports. The connecting means preferably comprises an internal, tapered annular channel for assisting in distributing the fluid.

Other details of the turbine ported grinding wheels of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
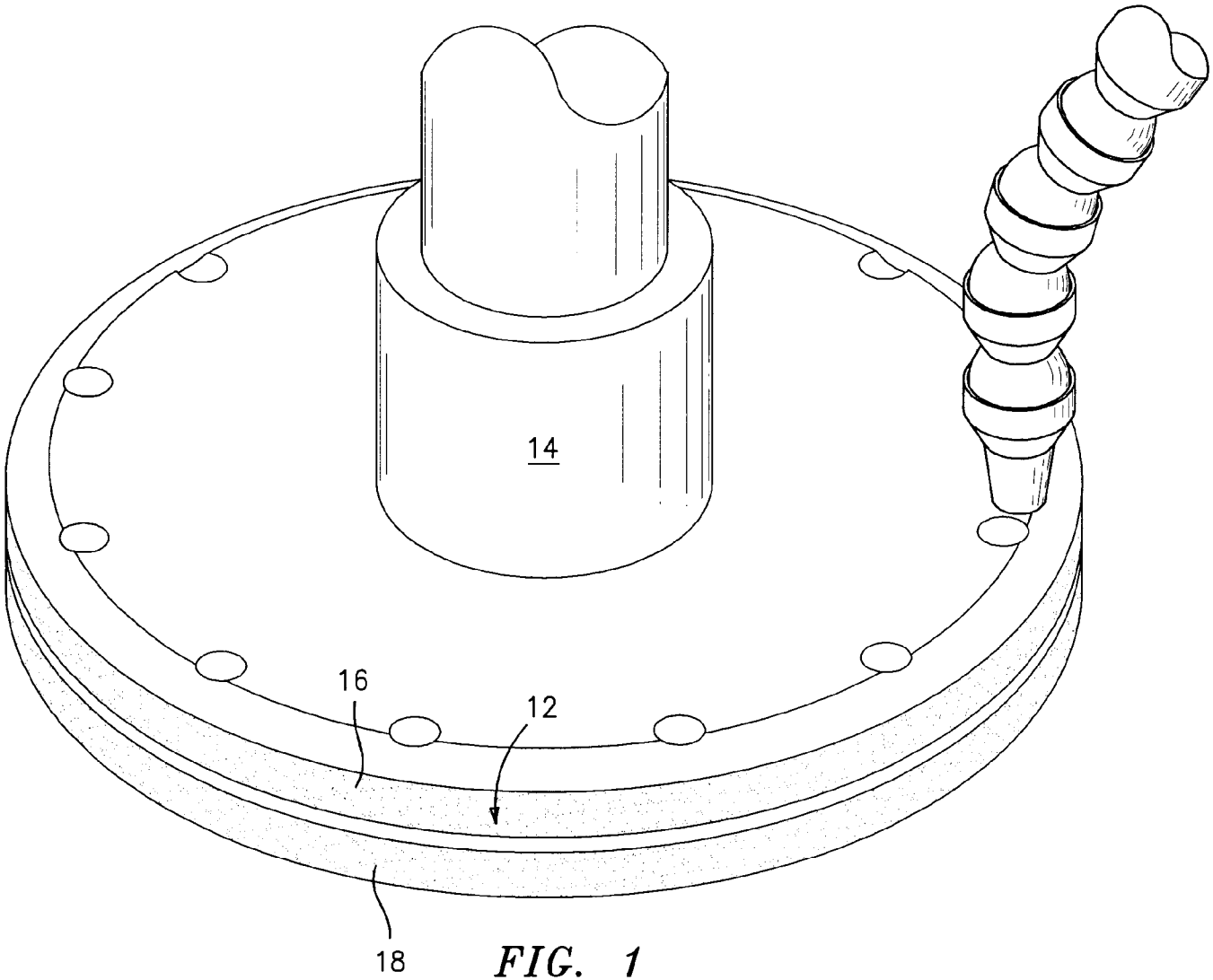
FIG. 1 is a top view of a grinding machine having stacked grinding wheels in accordance with a first embodiment of the present invention.

Referring now to the drawings, FIG. 1 illustrates a grinding machine 10 having a stacked grinding wheel 12 mounted on a motor driven spindle 14. The stacked grinding wheel 12 includes two grinding wheels 16 and 18 joined together by a plurality of threaded bolts or screws 20. Each of the grinding wheels 16 and 18 has a respective working surface 20 and 22 which is coated with an abrasive material such as cubic boron nitride or diamond particles. Each grinding wheel 16 and 18 has a central aperture 19 for receiving the spindle 14.

In the past, it has been difficult for coolant fluids or cutting fluids to be delivered to surfaces of the where the workpiece being ground and the grinding wheel meet. The present invention overcomes this difficulty by incorporating an internal fluid delivery system 24 into the grinding wheel 12.

Figure 2:
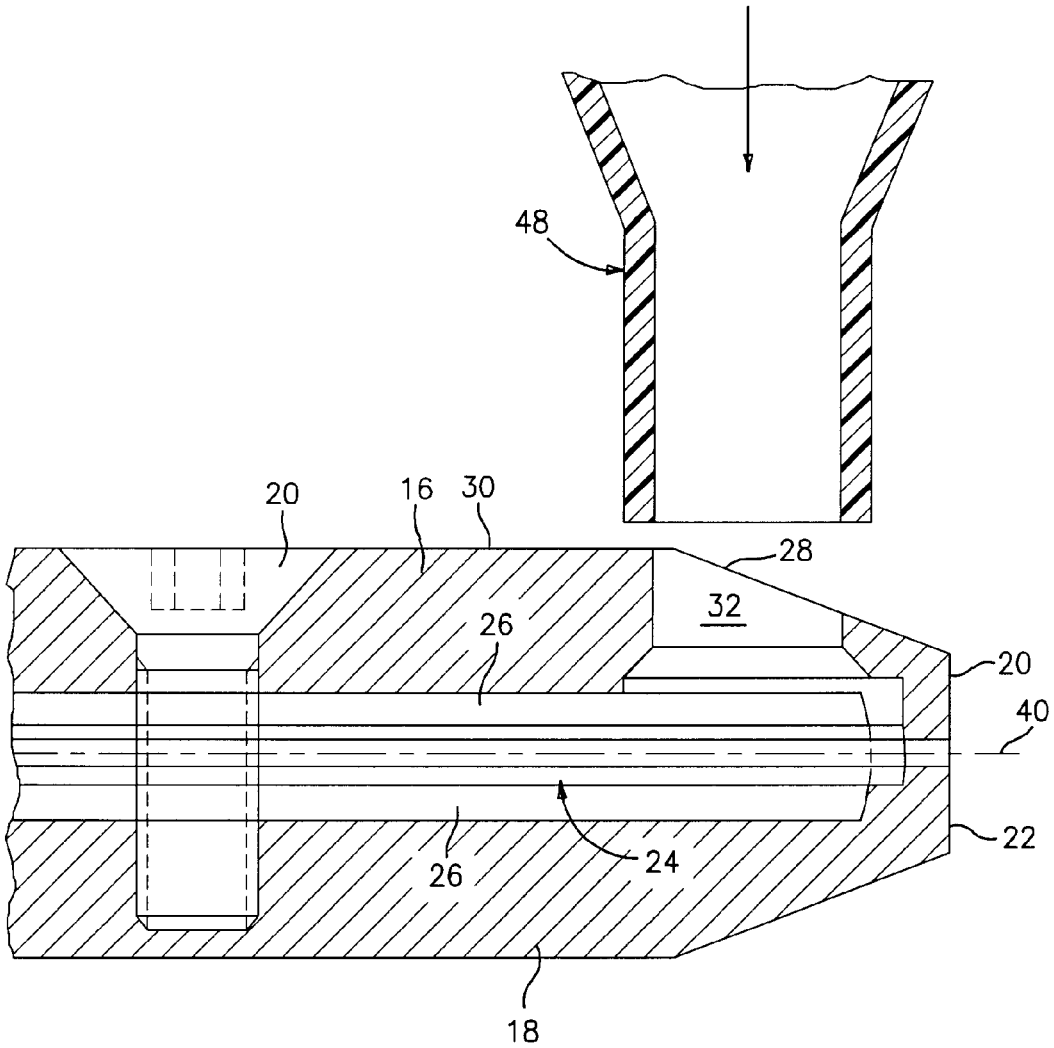
FIG. 2 is a sectional view of the stacked grinding wheels of FIG. 1.
Figure 3:
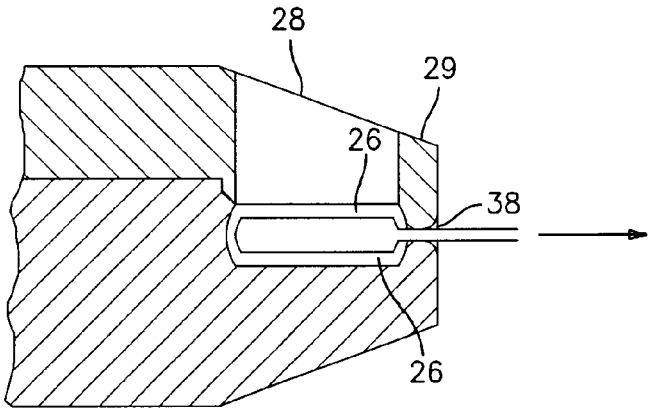
FIG. 3 is a sectional view of the internal, tapered annular channels used in the stacked grinding wheel of FIG. 1.
Figure 4:
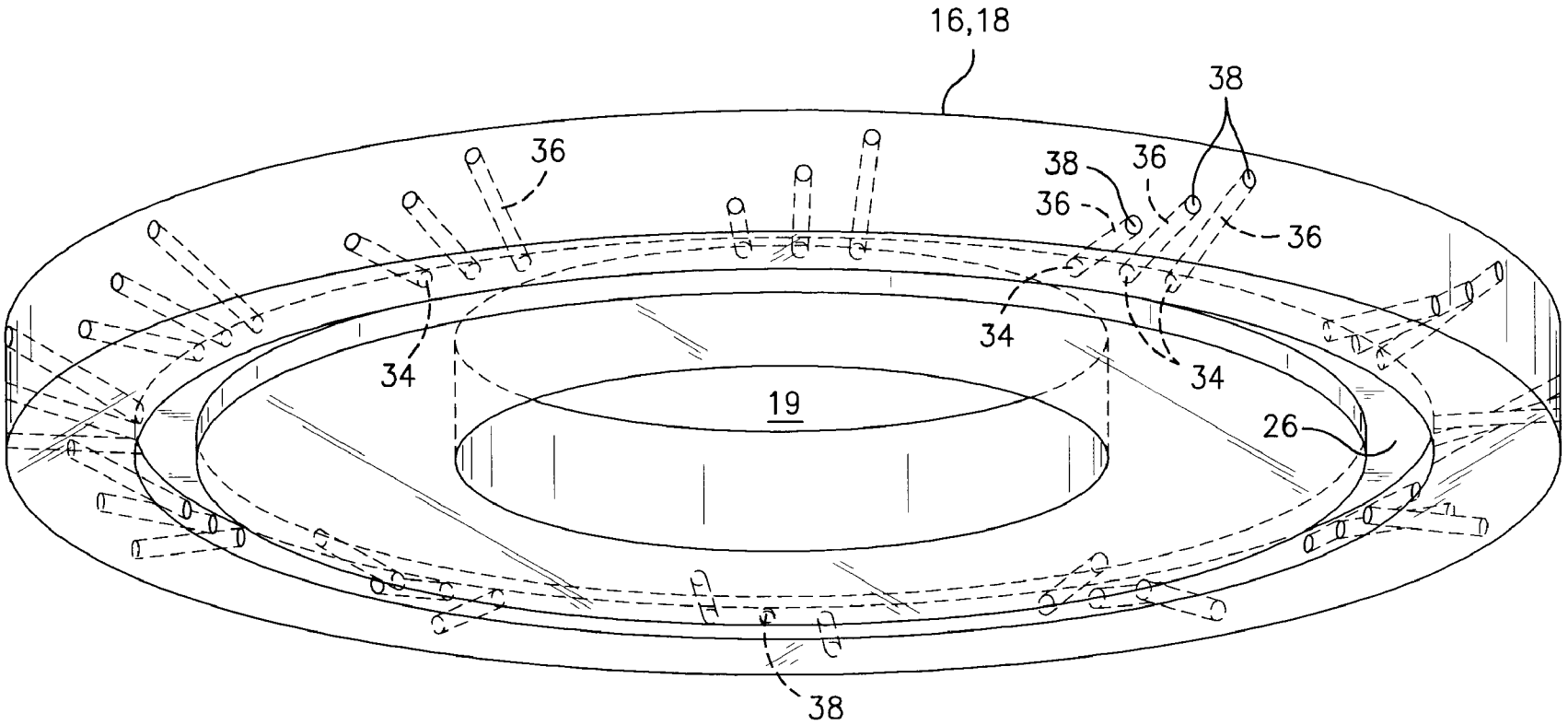
FIG. 4 is a perspective view of one of the stacked grinding wheels in FIG. 1.

The fluid delivery system 24 as shown in FIGS. 2–4 includes an internal annular channel 26 in each wheel 16 and 18. As shown in FIG. 3, each channel 26 is tapered to facilitate delivery of the fluid.

One of the channels 26 communicates with one or more fluid inlet ports 28 in a surface 30 of one of the grinding wheels 16 and 18 via one or more internal passageways 32. When the surface 30 contains a plurality of inlet ports 28, the inlet ports 28 are each located the same distance from the center of the grinding wheel 16 or 18 and are preferably located near the edge 29 of the grinding wheel. As shown in FIG. 3, the portion of the grinding wheel 12 near the edge 29 may be tapered.

Each of the channels 26 further communicates with the inlets 34 of a plurality of fluid passageways 36 machined into each of the wheels 16 and 18. Each of the fluid passageways 36 terminates in a fluid outlet 38 on one of the working surfaces 20 and 22.

The fluid passageways 36, if desired, may be clustered in groups of three as shown in FIG. 4. Alternatively, more than three fluid passageways 36 or just two fluid passageways 36 may be clustered together. Still further, individual fluid passageways 36 may be located around the circumference of the grinding wheel 16 or 18. The fluid passageways 36 may be angled with respect to a central axis 40 of the stacked grinding wheel 12 or may extend parallel to the central axis 40 of the stacked grinding wheel 12. The orientation of the passageways 36 depends on the location or locations where fluid needs to be delivered when grinding a particular workpiece.

The fluid delivery system 24 may be used to deliver a coolant fluid or a cutting fluid to the working surfaces 20 and 22 of the stacked grinding wheel 12. In operation, the coolant fluid or cutting fluid is supplied to the inlet port(s) 28 via a hose 42 having a nozzle 48. The hose 42 may comprise any suitable hose known in the art. As shown in FIG. 2, the nozzle 48 is preferably placed in close proximity to the inlet port(s) 28. As the stacked grinding wheel 12 rotates, the inlet port(s) 28 pass(es) by the nozzle 48 so that the fluid can flow into the port(s) 28. Centrifugal force moves the fluid through the center of the grinding wheel 12 to where it is needed at the point of contact.

If desired, for a vertically oriented grinding wheel, the nozzle 48 may be in either close proximity to the inlet port(s) 28 for injecting fluid into the inlet port(s) 28 in the manner described above or may be placed into contact with a particular inlet port 28. Any suitable means known in the art may be used to keep the nozzle 48 in contact with the inlet port 28.

In operation, coolant or cutting fluid is introduced into the interior of stacked grinding wheel 12 via the flexible hose 42, the nozzle 48, and the inlet port(s) 28. As the stacked wheel 12 rotates during the grinding operation, the turbine, impeller and centrifugal force effects cause the fluid in each channel 26 to pressurize and to be distributed via the passageways 36 to hard to get surfaces where the workpiece (not shown) and the grinding wheel 12 meet. By using extremely high pressure at the nozzle 48, the high pressure area that ordinarily envelops the working surfaces 20 and 22 can be pierced as the wheel 12 rotates.

Figure 5:
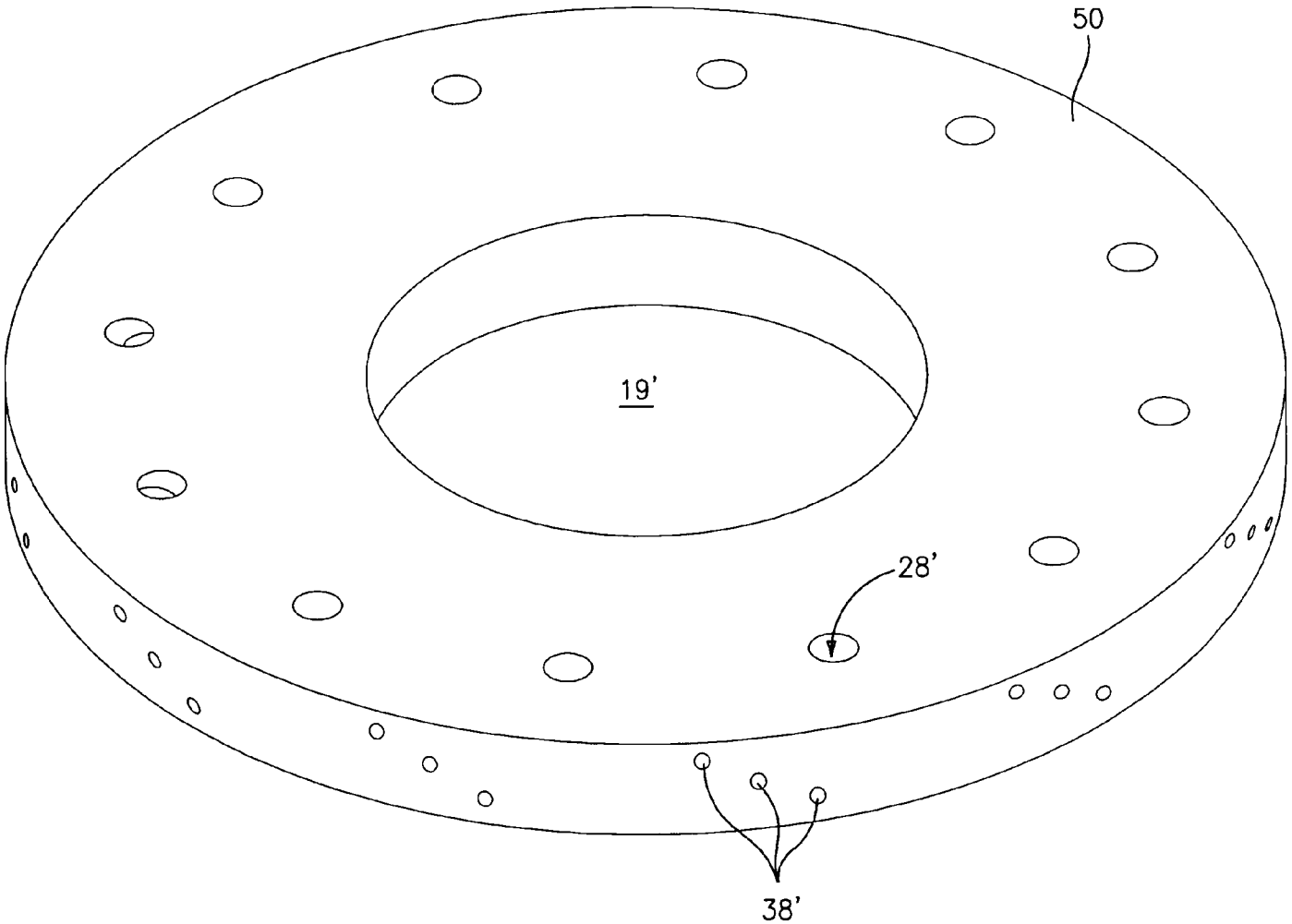
FIG. 5 illustrates an alternative embodiment of a grinding wheel in accordance with the present invention.
Figure 6:
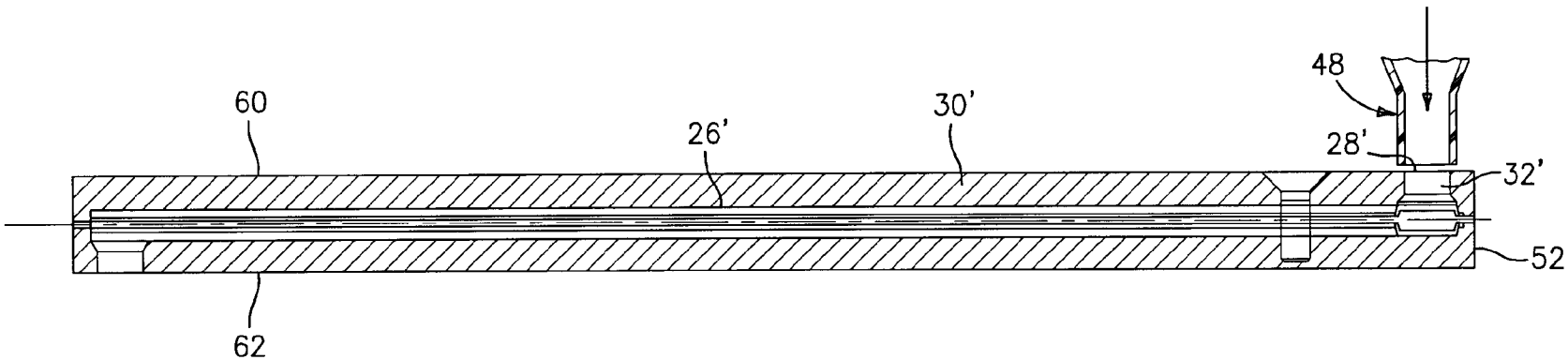
FIG. 6 is a sectional view of the wheel of FIG. 4.

Referring now to FIGS. 4 and 5, the fluid delivery system of the present invention may also be incorporated into a single non-stacked grinding wheel 50. As with the stacked grinding wheel, the single grinding wheel 50 has a central aperture 19' for receiving the spindle 14 of a grinding machine. The single grinding wheel 50 is made up of two halves 60 and 62 which are joined together by threaded screws or bolts 64.

The single grinding wheel 50 is provided with one or more fluid inlet ports 28' in a surface 30'. As before, when multiple inlet ports 28' are present, they are each located the same distance from the center of the grinding wheel 50. Each inlet port 28' communicates with a tapered, internal annular channel 26' via a respective passageway 32'. The internal annular channel 26' again communicates with a plurality of passageways machined into the wheel halves 60 and 62. Each of the passageways terminates in a fluid outlet 38' on a working surface 52 of the wheel 50. As before, the working surface 52 of the grinding wheel 50 may be coated with an abrasive material such as cubic boron nitride or diamond particles. Fluid is introduced into the grinding wheel 50 during operation via the hose 42 and the nozzle 48 which is in communication with the inlet port(s) 28'. The fluid is then delivered to locations where the working surface 52 meets the workpiece by the centrifugal, impeller and turbine forces generated during rotation of the wheel 50 and the fluid outlets 38'.

Grinding wheels having the internal fluid delivery system of the present invention provide a number of advantages. These include improved machine cycle time and wheel life. Further, the grinding wheels of the present invention help reduce economic costs in the manufacturing process. The grinding wheels of the present invention also help deliver fluids to difficult part geometry and fixturing constraints.

It is apparent that there has been provided in accordance with the present invention a turbine ported grinding wheel which fully satisfies the objects, means and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A grinding wheel for use on a grinding machine comprising:

a plurality of inlet ports located on a first surface of said grinding wheel;

a plurality of outlet ports on a working surface of said grinding wheel for delivering the fluid to said working surface;

internal means for connecting said inlet ports to said plurality of outlet ports; and each of said inlet ports being in fluid communication with;

wherein said internal connecting means comprises a tapered annular channel located internally of said grinding wheel.

2. A grinding wheel according to claim 1, wherein said connecting means further comprises a plurality of internal fluid passageways and each of said fluid passageways communicating with said annular channel and terminating in a respective one of said outlet ports.

3. A grinding wheel according to claim 1, further comprising an abrasive material on said working surface.

4. A grinding wheel according to claim 3, wherein said abrasive material comprises cubic boron nitride.

5. A grinding wheel according to claim 3, wherein said abrasive material comprises diamond particles.

6. A grinding wheel according to claim 1, further comprising each of said inlet ports being located equidistant from a center of said wheel.

7. A machine for grinding a workpiece comprising:

a stacked grinding wheel;

said stacked grinding wheel having at least one fluid inlet port in a first surface and a plurality of fluid outlet ports in at least one working surface;

internal means connecting said at least one fluid inlet port to said fluid outlet ports for delivering said fluid to a location where the at least one working surface of the grinding wheel meets the workpiece; and said stacked grinding wheel comprising first and second grinding wheels joined together.

8. A machine according to claim 7, wherein said machine has a motor driven spindle and said stacked grinding wheel has a central aperture for receiving said spindle.

9. A machine according to claim 7, wherein said internal means comprises an annular chamber in each of said first and second grinding wheels.

10. A machine according to claim 9, wherein said annular chamber in each of said first and second grinding wheels is a tapered annular chamber.

11. A machine according to claim 9, wherein said internal means further comprises each said inlet port being connected to one of said annular chambers via a respective channel.

12. A machine according to claim 9, wherein said internal means comprises a plurality of fluid passageways in each of said first and second wheels and each of said fluid passageways has an inlet which communicates with a respective one of said annular chambers and terminates in one of said fluid outlets.

13. A machine according to claim 7, wherein each of said grinding wheels has an abrasive working surface.

14. A machine according to claim 13, wherein each said abrasive working surface is formed from cubic boron nitride particles.

15. A machine according to claim 13, wherein each said abrasive working surface is formed from diamond particles.

16. A machine according to claim 7, further comprising a fluid hose with a nozzle and said nozzle being positioned in close proximity to said at least one inlet port for delivering said fluid to said at least one inlet port.

17. A grinding wheel for use on a grinding machine comprising:

a plurality of fluid inlet ports located on an outer first surface of said grinding wheel;

a plurality of outlet ports on a working surface of said grinding wheel for delivering the fluid to said working surface;

internal means connecting said at least one inlet port to said plurality of outlet ports; and each of said inlet ports being located equidistant from a center of said wheel.

18. A machine for grinding a workpiece, comprising a grinding wheel a plurality of inlet ports on an outer surface of said grinding wheel;

said grinding wheel having a working surface with a plurality of outlet ports;

an internal chamber in communication with at least one of said inlet ports and at least one of said outlet ports; and a conduit for supplying a fluid to said inlet ports, wherein said fluid can enter one of said inlet ports, travel through said internal chamber, and exit one of said outlet ports.

* * * * *